United States Patent [19]

Nguyen et al.

[11] Patent Number: 4,627,721

[45] Date of Patent: Dec. 9, 1986

[54] AUTOMATIC SCANNING OPTICS ALIGNMENT

[75] Inventors: Tuan A. Nguyen; Ronald T. Sosinski, both of Rochester; Wayne A. Buchar, Holcomb, all of N.Y.

[73] Assignee: Xerox Corporation, Stamford, Conn.

[21] Appl. No.: 800,176

[22] Filed: Nov. 20, 1985

[51] Int. Cl.[4] ..... G03G 15/00

[52] U.S. Cl. ..... 355/77; 355/14 R; 355/14 C; 355/55; 355/3 R

[58] Field of Search ..... 355/3 R, 77, 11, 8, 355/14 R, 14 C, 55

[56] References Cited

U.S. PATENT DOCUMENTS

| | | | |
|---|---|---|---|
| 3,788,739 | 1/1974 | Coriale | 355/3 R X |
| 4,050,806 | 9/1977 | Miyakawa et al. | 355/14 R |
| 4,181,429 | 1/1980 | Batchelor et al. | 355/77 |
| 4,206,995 | 6/1980 | Legg | 355/14 |
| 4,215,930 | 8/1980 | Miyakawa et al. | 355/14 E X |
| 4,284,344 | 8/1981 | Okamoto et al. | 355/14 E |
| 4,305,653 | 12/1981 | Evanitsky | 355/8 |
| 4,335,952 | 6/1982 | Conly et al. | 355/14 R |
| 4,460,268 | 7/1984 | Forrester | 355/8 |

*Primary Examiner*—A. C. Prescott

*Attorney, Agent, or Firm*—R. F. Chapuran

[57] ABSTRACT

The present invention is concerned with the automatic adjustment of the optical components in an optical scanning system after the tech rep has visually inspected sample copies with a test pattern and entered adjustment numbers at the control console. The control determines the optimum relative position of the optical components for a focus and various magnification ratios and stores these relationships as reference numbers in memory for reference at the selected magnification ratios. These reference numbers can be altered as future copies are inspected by the tech rep and appropriate evaluation numbers are entered into the control. In a specific embodiment, one sample copy is compared by the tech rep with the test pattern to adjust the magnification setting and a sequence of five set copies are produced to coarse adjust and fine adjust focus.

6 Claims, 3 Drawing Figures

AUTOMATIC SCANNING OPTICS ALIGNMENT

The present invention relates to an electrophotographic printing machine, and more particularly, to a more automatic technique for aligning the optical components in an optical scanning system.

In electrophotographic devices, such as xerographic copiers or printers, a scanning optical system including a lens and mirrors projects the image of a document onto a photo sensitive surface. The correct alignment of the lens and mirrors is essential for producing acceptable copies. The alignment and focus of the optical components becomes even more difficult if the machine is called upon to produce copies at different magnification ratios.

Many techniques are known in the prior art to check copy quality. For example, U.S. Pat. No. 4,181,429, Batchelor et al., discloses a technique to provide a sample copy for checking copy quality when the machine is stopped or in the midst of a copy run. The U.S. Pat. No. 4,206,995, Legg, shows a method of using diagnostic programs for operating machine components in a particular manner. In the Legg patent, the document handler can be conditioned to automatically move a document to a preselected location along the paper path to permit inspection for proper document alignment. U.S. Pat. No. 4,335,952, Conly et al., discloses a technique for inhibiting various subsystems of a copy machine in certain order to provide copy sheets that can be analyzed for indications of subsystems efficiency.

With regard to scanning optics, Forrester U.S. Pat. No. 4,460,268 teaches a control to automatically adjust the return speed of a scanning carriage. At start of the carriage flyback, an end of scan signal is generated and a second signal is generated when the carriage has reached the home position. These two signals conveyed to control logic determine the time period of the scan flyback. The time period of scan flyback is compared to an acceptable window or range of flyback time periods. If the flyback time period is outside the range, an adjust drive signal is conveyed to an adjust solenoid to activate a neumatic-pod air bleed screw resulting in an automatic adjustment of the neumatic-pod. Evanitsky, U.S. Pat. No. 4,305,653, teaches the recording of time periods between energization of an optics clutch and activation of a scan switch at the end of scan position and between de-energization of the optics clutch and actuation of the scan switch at the home position. These time periods are available to a tech rep upon entering a diagnostic mode on a display screen for diagnostic purposes.

A difficulty, however, in the prior art with optics scan systems is to be able to easily and simply adjust the relative alignment of the optical components. Often this has been a very labor intensive, time consuming process requiring the tech rep to make many visual observations and manual adjustments to provide acceptable alignment. This procedure is often repeated at the installation of the optics, after a malfunction or misoperation of the machine, after a change of components, or merely to fine tune the operation of the machine.

It would be desirable, therefore, to eliminate a great deal of the time and labor needed to adjust the relative position and alignment of the optics components in an optics scanning system.

It is an object of the present invention, therefore, to provide a new and improved optics alignment procedure. It is another object of the present invention to provide an optics alignment procedure that is labor saving, time saving, as well as reliable in aligning the optical components in an optics system for a variety of magnification ratios. Further objects and advantages of the present invention will become apparent as the following description proceeds and the features characterizing the invention will be pointed out with particularity in the claims annexed to and forming a part of this specification.

Briefly, the present invention is concerned with the automatic adjustment of the optical components in an optical scanning system after the tech rep has visually inspected sample copies with a test pattern and entered adjustment numbers at the control console. The control determines the optimum relative position of the optical components for focus and various magnification ratios based on these adjustment numbers and stores these relationships as reference numbers in memory for reference at the selected magnification ratios. These reference numbers can be altered as future copies are inspected by the tech rep and appropriate evaluation numbers are entered into the control. In a specific embodiment, one sample copy is compared by the tech rep with the test pattern to adjust the magnification setting and a sequence of a set of five copies are produced to coarse adjust and fine adjust focus.

For a better understanding of the present invention, reference may be had to the accompanying drawings wherein the same reference numerals have been applied to like parts and wherein.

Figure 1:
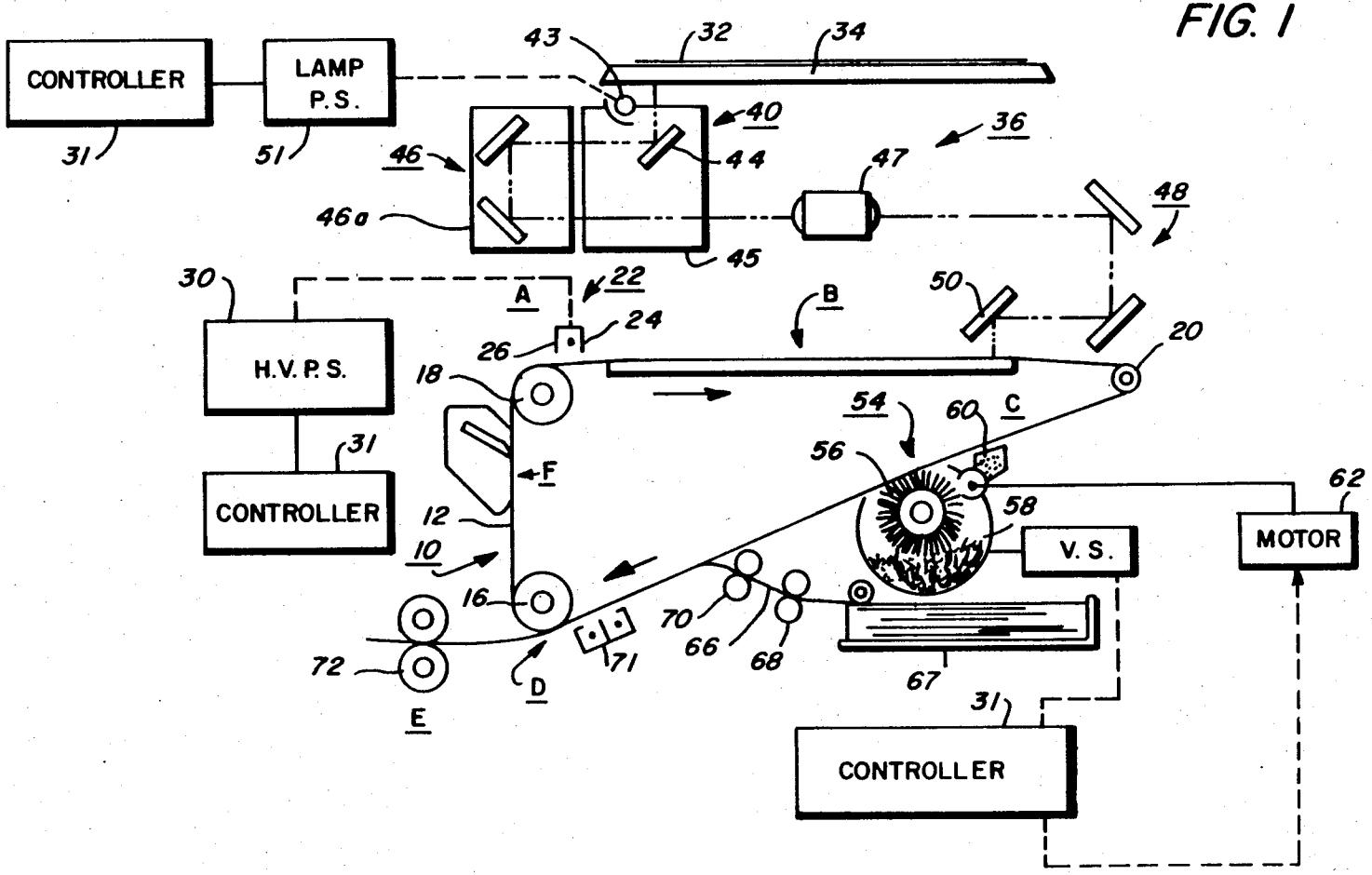
FIG. 1 is a representation of a reproducing apparatus incorporating the present invention.

FIG. 1 schematically depicts the various components of an illustrative electrophotographic printing machine incorporating the control system of the present invention therein. It will become apparent from the following discussion that this control system is equally well suited for use in a wide variety of electrophotographic printing machines and is not necessarily limited in its applications to the particular embodiment shown herein. Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine uses a photoreceptor belt 10 having a photoconductive surface 12 formed on a conductive substrate. Belt 10 moves in the indicated direction, advancing sequentially through the various xerographic process stations. The belt is entrained about drive roller 16 and tension rollers 18, and 20. Roller 16 is driven by conventional motor means, (not shown).

With continued reference to FIG. 1, a portion of belt 10 passes through charging station A where a corona generating device, indicated generally by the reference numeral 22, charges photoconductive surface 12 to a relatively high, substantially uniform, negative potential. Device 22 comprises a charging electrode 24 and a conductive shield 26. A high voltage supply controlled by a portion of controller 31, is connected to shield 26.

As belt continues to advance, the charged portion of surface 12 moves into exposure station B. An original document 32 is positioned, either manually, or by a document feeder mechanism (not shown) on the surface of a transparent platen 34. Optics assembly 36 contains the optical components which incrementally scan-illuminate the document and project a reflected image onto surface 12 of belt 10. Shown schematically, these optical components comprise an illumination scan assembly 40, comprising illumination lamp 42, associated reflector 43 and full rate scan mirror 44, all three components mounted on a scan carriage 45. The carriage ends are adapted to ride along guide rails (not shown) so as to travel along a path parallel to and beneath, the platen. Lamp 42 illuminates an incremental line portion of documents 32. The reflected image is reflected by scan mirror 44 to corner mirror assembly 46 on a second scan carriage 46A moving at ½ the rate of mirror 44. The document image is projected through lens 47 and reflected by a second corner mirror 48 and belt mirror 50, both moving at a predetermined relationship so as to proceed the projected image, while maintaining the required rear conjugate onto surface 12 to form thereon an electrostatic latent image corresponding to the informational area contained within original document 32. Adjustable illumination power supply 51, controlled by a portion of controller 31, supplies power to lamp 42.

At development station C, a magnetic brush development system, indicated generally by the reference numeral 54, advances an insulating development material into contact with the electrostatic latent image. Preferably, magnetic brush development system 54 includes a developer roller 56 within a housing 58. Roller 56 transports a brush of developer material deforms belt 10 in an arc with the belt conforming, at least partially, to the configuration of the developer material. The electrostatic latent image attracts the toner particles from the carrier granules forming a toner powder image on photoconductive surface 12. As successive latent images are developed, toner particles are depleted from the developer material. A toner particle dispenser, indicated generally by the reference numeral 60 provides additional toner particles to housing 58 for subsequent use by developer roller 56. Toner dispenser 60 includes a container for storing a supply of toner particles therein and means (not shown) for introducing the particles into developer housing 58. A motor 62, when energized, initiates the operation of dispenser 60.

An output copy sheet 66 taken from a supply tray 67, is moved into contact with the toner powder image at transfer station D. The support material is conveyed to station D by a pair of feed rollers 68 and 70. Transfer station D includes a corona generating device 71 which sprays ions onto the backside of sheet 66, thereby attracting a toner power image from surface 12 to sheet 66. After transfer, the sheet advances to fusing station E where a fusing roller assembly 72 affixes the transferred powder image. After fusing, sheet 66 advances to an output tray (not shown) for subsequent removal by the operator. After the sheet of support material is separated from belt 10, the residual toner particles are removed at cleaning station F.

Figure 2:
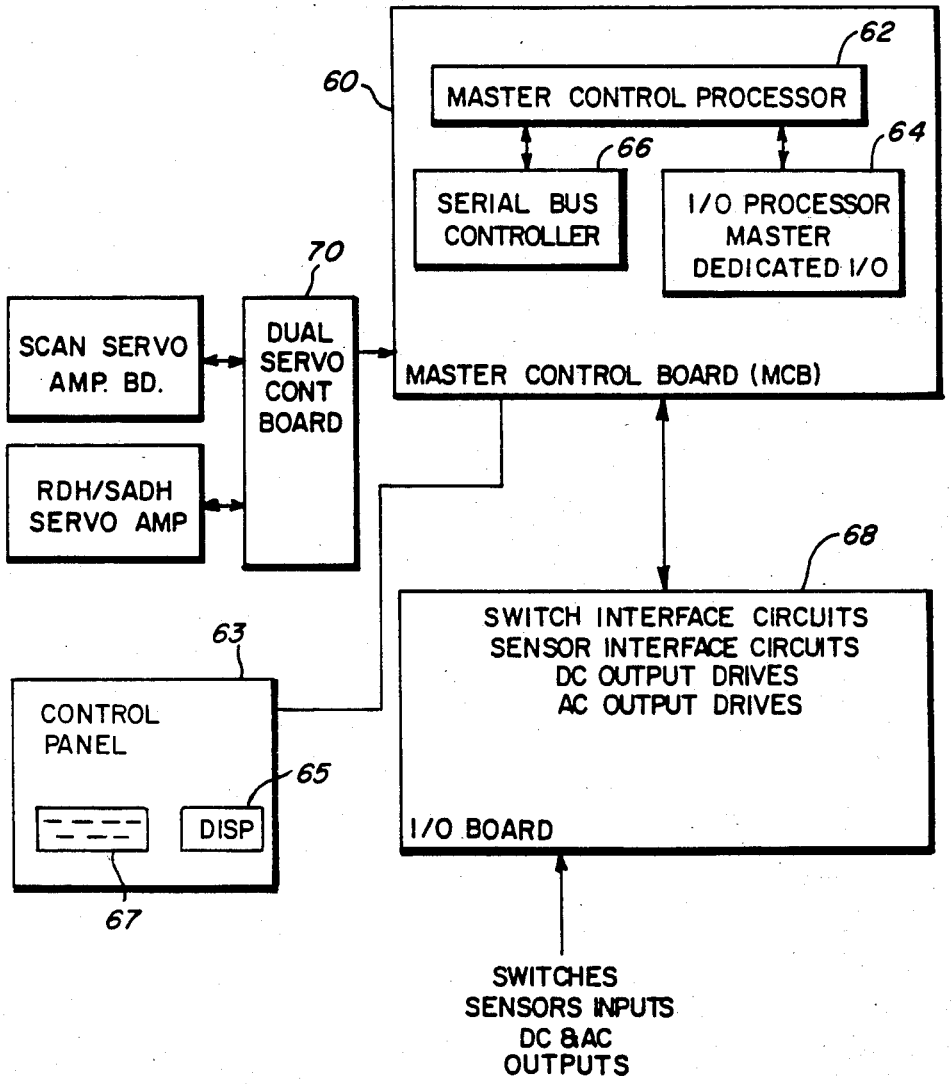
FIG. 2 is a generalized block diagram of the control for use in the machine disclosed in FIG. 1.

With reference to FIG. 2, there is illustrated the general control of the xerographic printing machine. In particular, the controller 31 includes a master control board 60, including an Intel 8085 master control processor 62, an Intel 8085 input/output processor 64 and a serial bus controller 66 connected to an input/output board 68 including various switch and sensor interface circuits and DC and AC output drivers. In a preferred embodiment the master control processor includes 80K ROM, 8K RAM and 2K MBM memories and suitable timing and reset circuitry. The input/output processor includes 8K ROM, 2K RAM, AD and DA converters and an 8253 timer and 8259 interrupt controller, as well as suitable input and output ports. The master control board 60 is also connected to a dual servo control board 70 over a serial bus for handling scan and document handling servos. Also connected to the master control board 60 is a control panel 63 with suitable display 65 and key board 67 for entering program data and displaying control and diagnostic information.

In accordance with the present invention, in the diagnostic state, the tech rep will set up the lens 47 and the half rate carriage **47*a*** position for 1× and 65% reduction modes to achieve proper magnification and focus. It is well known to enter a diagnostic mode by use of a particular key board combination or dedicated switch.

When the diagnostic state is entered, the following message will be displayed:

POSITION TEST PATTERN

PRESS START

After "START" is actuated, and if fuser is up to temperature, the machine will make one copy and cycle down and the following message will be displayed:

100 PERCENT MAG

IS IT IN SPEC (Y OR N)

The tech rep will then align the copy that has been produced with a test pattern. If the 100% magnification line of the copy does not match the test pattern line, the "N" button is pushed and the following message is displayed:

ENTER REFERENCE NUMBER PRESS Y

NUMBER ENTERED=0

At this time, the tech rep will enter an offset number visually determined from the misalignment of the copy and the test pattern. It is contemplated to use within the scope of this invention any suitable calibrated test pattern. This step is merely a visual comparison by the tech rep of the copy produced from the test pattern and entering deviation numbers that are provided on the test pattern. Entries in a preferred embodiment of a test pattern can range from 0 to 36. The number 18 represents no change in the value of the 100% mag lens NVM variable. This is the reference variable initially stored in non-volatile memory as the systems correct alignment. Each unit below 18 represents the enlargement of the previous copy by one pattern line. Each unit that the entry is above 18 corresponds to the previous copy being reduced one test pattern line. After entering the correct number and pressing the "Y" button the non-volatile memory location is adjusted to its new value and the following message will be displayed.

PRESS START TO CONTINUE

At this point actuation of the "START" button will start a coarse focus adjustment for the half rate carriage at 1×. Then the machine will make 5 copies and cycle down. At cycle down, the message

ENTER COPY NUMBER WITH BEST FOCUS

COPY NUMBER ENTERED=0 is displayed. This requires the tech rep enter the number of the copy with the best focus as determined from visual inspection. Number one represents copy 1, number two represents copy 2, etc. That is, if the best focus copy is the third copy made, the tech rep will enter number 3. If the best focus copy is number 1 or number 5, the machine will stay on coarse focus adjustment and the sequence repeated.

If numbers 2, 3, or 4 are entered, the machine will perform fine focus adjustment for the half rate carriage and go on to fine focus adjustment. In the fine focus mode, there is a finer step adjustment than in the coarse adjustment. Five copies will be made and machine will cycle down.

Again, the tech rep will have to enter the copy number with best focus. At this time, magnification will be rechecked and the operation will proceed from the original magnification message above.

If the mag was in spec and the "Y" button was pushed after the original mag message, then the following message will be displayed instead of the "PRESS START TO CONTINUE" message:

FOCUS IS IN SPEC (Y OR N)

PRESS START

When the 65% magnification setup is reached the following message will be displayed:

65 PERCENT MAG

IS IT IN SPEC (Y or N)

At this point the procedure follows the exact procedure as in 100% magnification case. When the 65% magnification setup and focus adjustment has been completed the following message will be displayed:

OPTICS NVM DISPLAY

PRESS START TO SCROLL

Pressing the "START" button will display each of the five NVM locations which may have been changed in this routine. The tech rep will record these values in a log book. Successive pushes of the "START" button will cause the display to wrap around. This routine will start in this state until the "P" button is pushed causing the routine to be exited and display the diagnostic executive message.

Note: If any of the following conditions ever result during this routine:

NVM for LENX@1× less than 400 or greater than 900

NVM for (LENX@1×+LENX2DELN) is less than 1300 or greater than 2250

NVM for HRC@1× is less than 100 or greater than 700

NVM for (hrc@1×_HRC2DELN) is less than 400 or greater than 2100

The following message will be displayed:

NUMBER ENTERED EXCEEDS THE OPERATING LIMITS. PRESS P FUNCTION TO EXIT

In this case, the tech rep must exit the diagnostic mode, reset the NVM number and restart the setup routine again. These are indications beyond the adjustable range of the machine.

Figure 3:
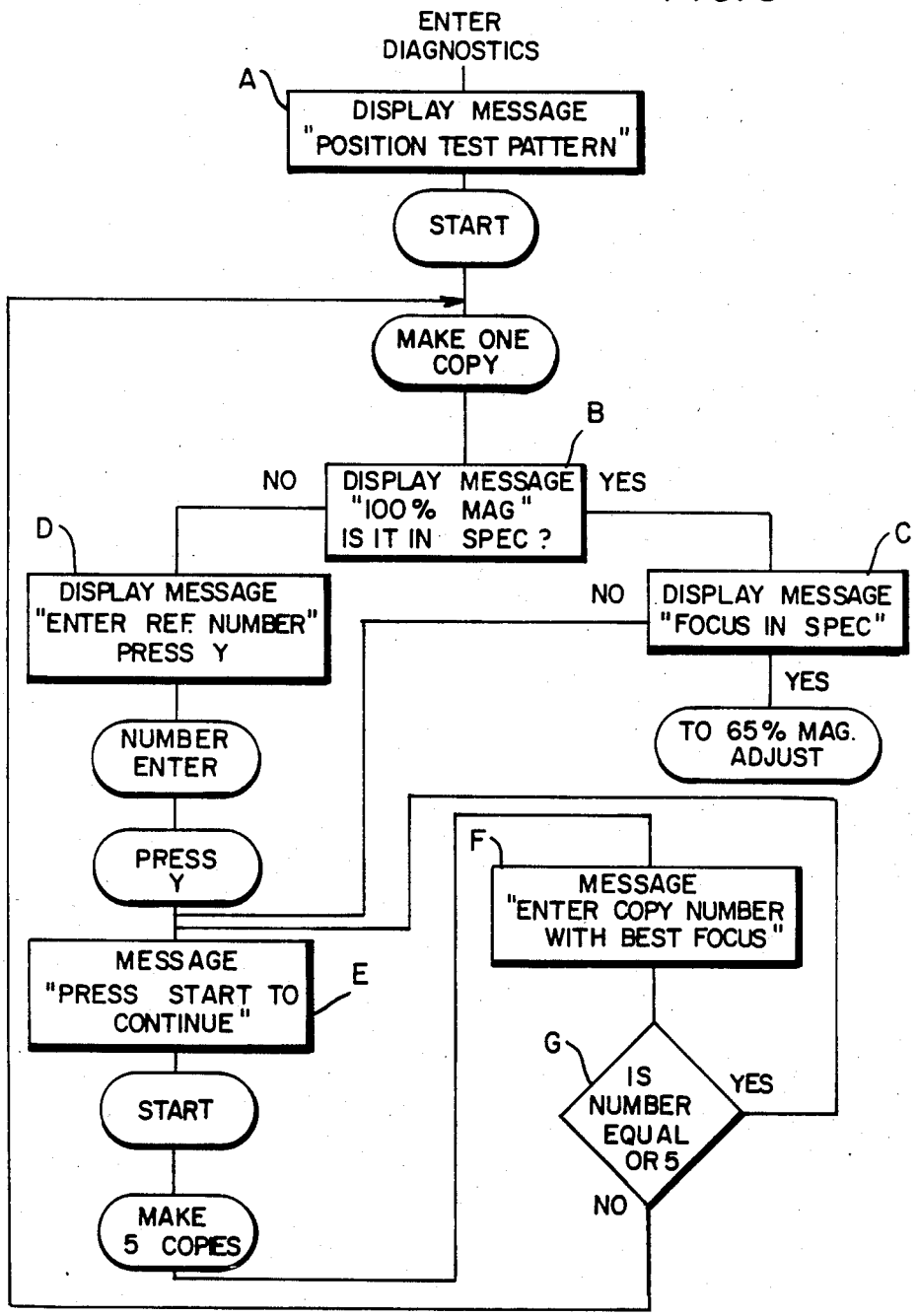
FIG. 3 is flow chart in accordance with the present invention illustrating the automatic adjustment and alignment of the optic system shown in FIG. 1.

The procedure described above is shown graphically with reference to the FIG. 3 flow chart. In the first step, the tech rep enters the diagnostic mode. In block A, the message is displayed to position the test pattern and to press start. Before the machine makes one copy there is a machine initialization for the fuser to come up to temperature. Also, the lens and the half rate carriage are moved to their home positions for 100% magnification and the position of the lens is made to correspond to the paper in the paper tray selected in those machines having a plurality of paper trays. After the first copy is made, the tech rep is prompted to visually inspect the copy, as illustrated in block B. The tech rep then visually compares the copy with his test pattern by aligning the two sheets along a reference line. The degree of misalignment is indicated by a 100% magnification line on the copy. The degree of misalignment will be determined by a gauge on the test pattern with reference numbers from 0 to 36. If there is no misalignment, the tech rep will proceed to check the focus settings of the machine as illustrated in block C.

However, if there is misalignment the tech rep will be prompted to enter the appropriate number showing the degree of misalignment from the gauge on the test pattern into the control panel. This is illustrated in block D. The number is entered. A new number is then automatically calculated for a correct setting of the optics in the 100% magnification mode. The calculation is:

$$\text{MAG} = \frac{149.5 - \frac{\text{MAG REF NO. 18}}{3}}{149.5}$$

This new number for correct setting of the optics in the 100% magnification mode is then inserted in the non-volatile memory to replace the old number. It should also be noted that there is a fail safe check on the numbers to be entered in non-volatile memory. In other words, if the number is outside a given range, the number is not entered and there is an indication that the number exceeds the operating limits and that the test must be run again.

After the magnification adjustment and the new number is stored in non-volatile memory, there is a message to press start to continue the operation to adjust for focus, as illustrated in block E. The start button is then pushed and the machine again initializes the lens and the half rate carriage to the new positions for 100% magnification and again to correspond to the paper tray selected. The machine makes five copies, each copy at a different step of the stepper motor controlling the movement of the optics to give five copies with a different image for each step of focus. The tech rep numbers the copy sheets 1, 2, 3, 4, and 5 as they are produced by the machine and visually selects the copy with the best focus, comparing the copies with the test pattern with reference to block F. The tech rep then enters the number, either 1, 2, 3, 4, or 5 at the control console of the copy which shows the best focus. This is a coarse focus adjustment. If the best copy for focus was either the first or the 5th copy, then the coarse focus adjustment procedure is repeated again, illustrated by decision block G. This is because if it is either copy one or copy five, there may be an indication that the best coarse adjustment was at the limit of the range tested and a further coarse adjustment may be desirable.

The new number is entered in non-volatile memory and the machine is again initialized with a new position of the lens and the half rate carriage and five more copies are produced for another evaluation for best focus. Again the number of the best copy is entered at the control. If the best copy is either 2, 3, or 4, a new position for the optics is determined and entered into non-volatile memory and the optics moved to the new position. This time there is a message to press start to continue and the procedure enters a fine focus adjustment phase.

This is the same as the coarse focus adjustment except that there is a finer degree of difference or steps in moving the optics to obtain the five copies compared with larger steps or degree of movement for the coarse adjustment. Since this is basically the same loop only with a finer movement of optics, this particular loop is not shown in the flow chart. However, the same procedure follows, the five copies are made and numbered and the tech rep compares the copies with the standard test pattern and selects the best for focus. Again, if the best is a 1 or 5, this procedure is repeated until the best copy is either a 2, 3, or 4. At this time the new number is entered in the non-volatile memry. As shown in the flow chart at decision block G, at this point the procedure loops to the 100% magnification again. It should be noted that the loop to block B from decision block G would come normally after the fine focus adjustment, but for purposes of brevity, is shown in FIG. 3 after the coarse focus adjustment. After the focus adjustment is made there is always another copy made to verify that the magnification setting is still within limits for 100% magnification. Assuming that if the 100% magnification setting is out of range, the routine will be repeated to set a new magnification setting and after the magnification is changed there must always be a focus adjustment.

Assuming, however, that the magnification 100% magnification setting is correct, the tech rep will then immediately check visually if the focus is acceptable. This is a visual inspection and if it is visually acceptable, there is no adjustment made and the tech rep will proceed to the 65% magnification adjustment including focus. If upon the visual inspection after the magnification is correct it is determined that there should be a focus adjustment as shown in the flow chart, the procedure is to begin the focus adjustment illustrated in block C. That is five copies will be made with a course adjustment proceeding to the fine adjustment. After the completion of the 100% magnification testing, the same procedure will be repeated for the 65% magnification adjustment.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. In an electrophotographic printing machine having a scan illumination optical system for illuminating a document to be copied on a platen surface and for projecting an image of the document along an optical path onto a photoreceptor to form a latent image, the scan illumination system including a lens and a plurality of mirrors, the printing machine including a controller having a memory, the method of aligning the optical system comprising the steps of:

entering the diagnostic mode, positioning a test pattern on the platen and making one copy thereof, visually inspecting the test pattern and the copy for variations, entering a number at the control panel indicating the degree of variation, calculating a reference number for storage and memory indicating the relative positions of the lens and mirrors, making additional copies of the test pattern in response to the new relative position of the optical components, visually comparing the additional copies with the test pattern to select the best copy for focus, entering the best copy number at the control console and calculating a new relative position of the optical components for focus, and storing the new number representing the new relative position in memory.

2. The method of claim 1 including the steps of repeating the sequence of comparing additional copies with the test pattern after the first focus adjust for a second focus adjust.

3. In an electrophotographic printing machine having a scan illumination optical system for illuminating a document to be copied on a platen surface and for projecting an image of the document along an optical path onto the photoreceptor, the scan illumination optical system including a lens and a plurality of mirrors, the apparatus including a control panel having data entering devices, and a control with memory for storing data indicating the relative position of the lens and mirrors in a first state, the method of aligning the optical system lens and mirrors including the steps of:

making copies of a test pattern with the mirror and lenses positioned at said first state, comparing the copies and the test pattern to determine the degree of misalignment of the lens and mirrors, entering data at the control console indicating the degree of difference of alignment of one of the copies with the test pattern, calculating a new number representing the correct relative position of the lens and mirrors in said first state, and repeating the sequence to verify the correct alignment of the lens and mirrors.

4. The method of claim 3 wherein the step of calculating a new number representing the degree of correct alignment is for the optical system components at a 100% magnification ratio.

5. The method of claim 3 including the step of calculating a number representing the correct alignment of the optical components at a 65% magnification ratio.

6. The method of claim 3 including the steps of:

calculating a correct alignment number for the optical components at a 100% magnification and within an acceptable focus range.

* * * * *